United States Patent [19]

Garabedian

[11] 4,109,634

[45] Aug. 29, 1978

[54] APPARATUS FOR MODIFYING AN INTERNAL COMBUSTION ENGINE

[75] Inventor: Arthur Garabedian, 1111 Glenview Dr., Fullerton, Calif. 92634

[73] Assignees: Dudley B. Frank; Arthur Garabedian, both of Santa Ana, Calif.

[21] Appl. No.: 774,343

[22] Filed: Mar. 4, 1977

Related U.S. Application Data

[63] Continuation of Ser. No. 503,718, Sep. 6, 1974, Pat. No. 4,019,479.

[51] Int. Cl.[2] ..... F02D 9/00; F02M 13/04

[52] U.S. Cl. ..... 123/198 F; 261/23 A

[58] Field of Search ..... 123/198 F, 198 R, DIG. 6, 123/DIG. 7; 261/23 A

[56] References Cited

U.S. PATENT DOCUMENTS

| | | | |
|---|---|---|---|
| 2,114,655 | 4/1938 | Lerbing | 123/198 F |
| 2,166,968 | 7/1939 | Rohlin | 123/198 F X |
| 2,315,183 | 3/1943 | Bichnell et al. | 123/198 F |
| 2,379,288 | 6/1945 | Ericson | 123/198 F |
| 2,623,617 | 12/1952 | Snyder et al. | 123/198 F |
| 2,837,322 | 6/1958 | Thome et al. | 261/23 A |
| 3,121,422 | 2/1964 | Boher | 123/198 F X |

*Primary Examiner*—Ira S. Lazarus

*Attorney, Agent, or Firm*—Knobbe, Martens, Olson, Hubbard & Bear

[57] ABSTRACT

A device for splitting the operation of a multicylinder internal combustion engine to allow the use of one group of the cylinders during a first phase of operation and the use of both the first and second group of the cylinders during a second phase of operation. In the first phase of operation all fuel and air is blocked by a throttle valve from entering the inactive second group of cylinders, causing these cylinders to operate in a vacuum environment. The throttle controlling the second group of cylinders operates in response to the operation of a throttle controlling the first group of cylinders. In an alternative embodiment, the throttle of the second group of cylinders is kept slightly open during the first phase of operation to provide just enough fuel and air to the second group of cylinders to provide power to turn the pistons in the second group of cylinders and reduce the potential drag forces to the active first group of cylinders.

8 Claims, 6 Drawing Figures

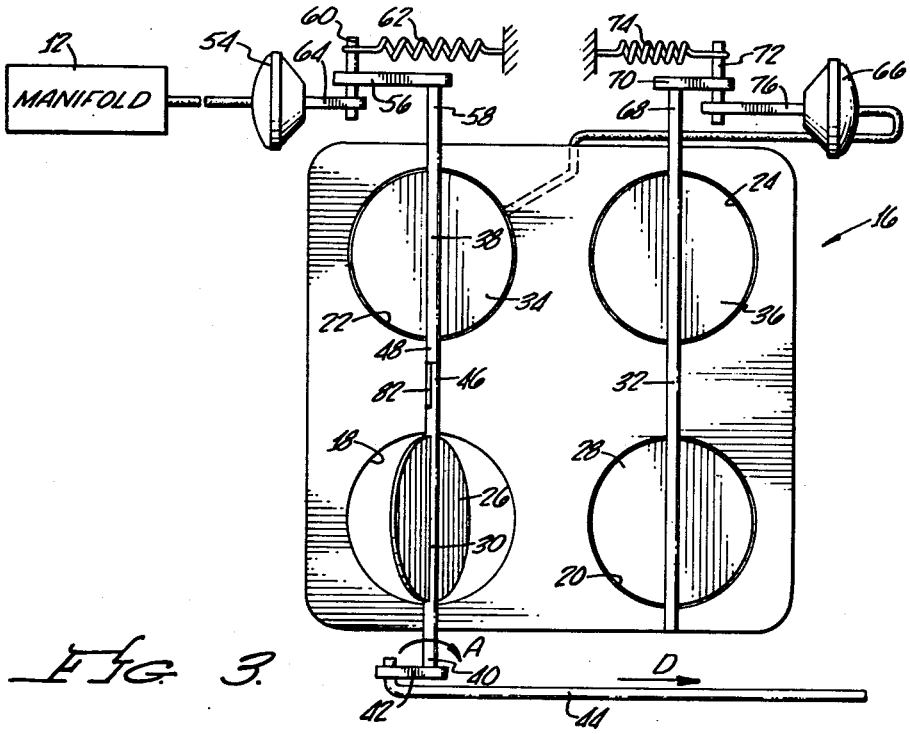
FIG. 3.
FIG. 4.
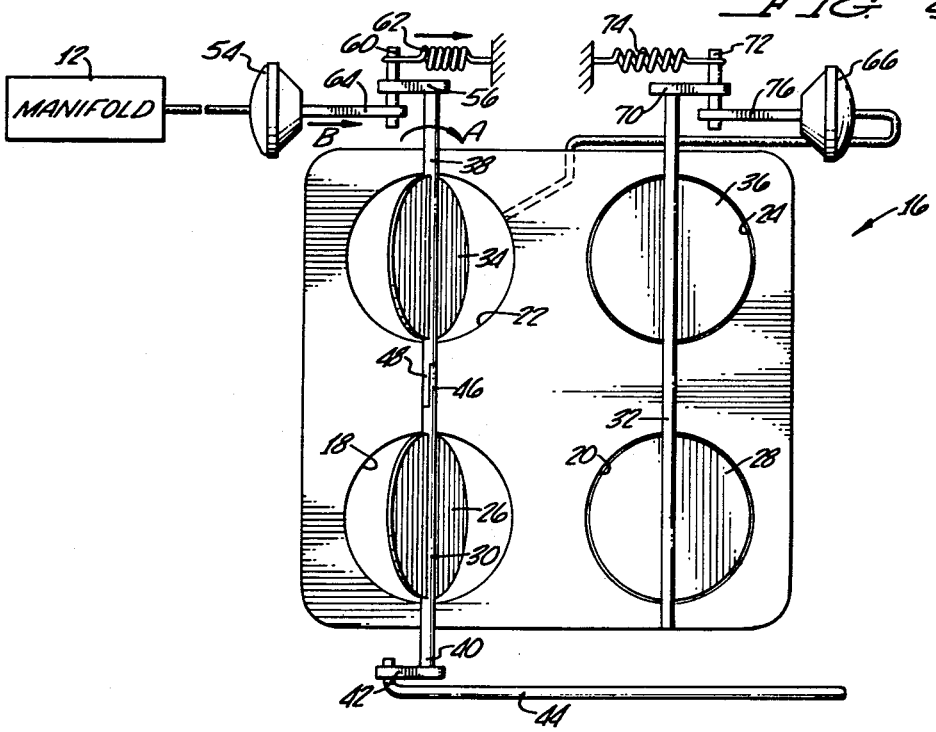

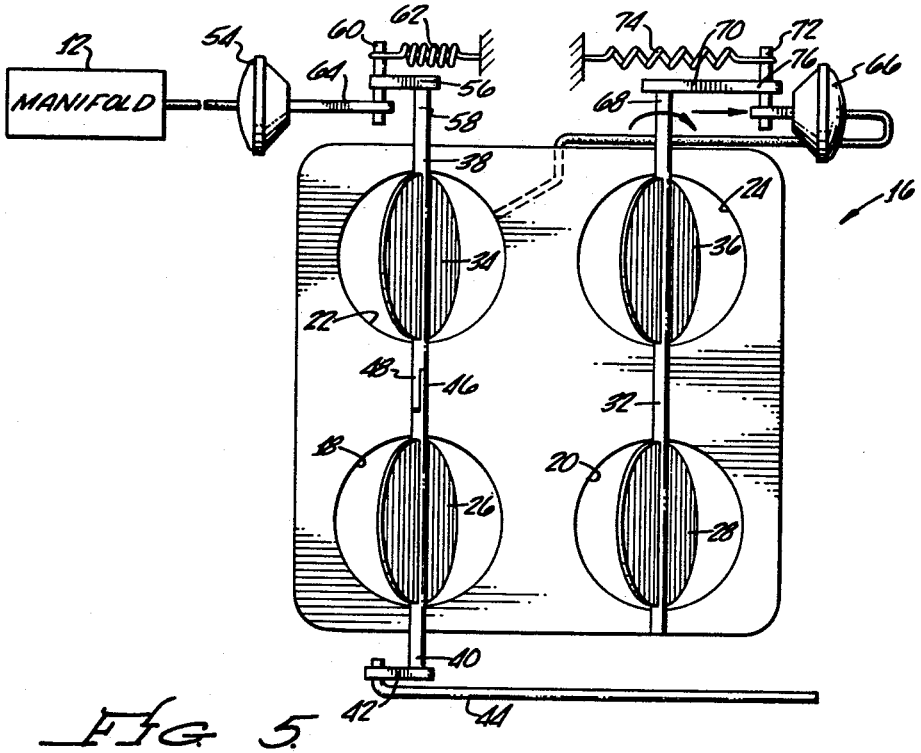
FIG. 5
FIG. 6
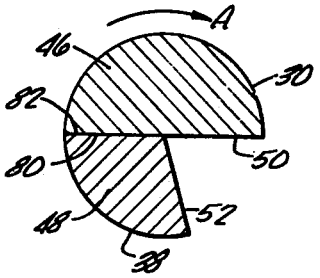

APPARATUS FOR MODIFYING AN INTERNAL COMBUSTION ENGINE

This is a continuation of application Ser. No. 503,718, filed Sept. 6, 1974, now U.S. Pat. No. 4,019,479, issued Apr. 26, 1977.

BACKGROUND OF THE INVENTION

The present invention relates to the field of internal combustion engines and more specifically relates to mechanisms used to split the operation of an internal combustion engine, so that it has the capability to alternately operate on half or all of its cylinders.

It has long been known that internal combustion engine efficiency is greatest when the cylinders are operating under relatively high loads. However, the normal operating conditions of, for instance, a typical automobile engine do not place the requisite high loads on the cylinders, resulting in uneconomical fuel consumption a great percentage of the operating time. The efficiency of the engine is directly related to the amount of air being compressed to produce the power output of the engine, since maximum air is supplied to the cylinders when the throttle is open for high loads. Given the fact that cylinder load increases compression pressures which increase engine efficiency, the advantage of having a split engine becomes apparent by imparting high loads to half of the cylinders during normal operating conditions.

Included in the design of a split engine modification is the ability to utilize all the cylinders when the engine experiences heavier loads or higher performance requirements. This provides the operator of the split engine the advantages at both good fuel economy under normal operating conditions and reserve power when needed.

One area of concern, however, in obtaining optimum efficiency with a split engine design has been the possible drag forces caused by the inactive pistons being turned within their cylinders by the engine crankshaft. The energy needed to turn these inactive pistons is a power drain on the active pistons, decreasing fuel economy.

SUMMARY OF THE INVENTION

The present invention comprises a throttle control device for use on internal combustion engines to split the fuel and air mixture feed system into two separate entry ports, so that one fuel and air mixture feed port operates one half of the cylinders and the other fuel and air mixture feed port operates the other half of the cylinders. Each feed port is controlled by a separate throttle valve.

One half of the cylinders are the active cylinders which are always operating when the engine is operating. The other half of the cylinders are inactive, operating only when the engine experiences very high loads or higher performance requirements. The operation of the throttle valve controlling the inactive cylinders is responsive to the amount of opening of the throttle valve controlling the active cylinders.

To help alleviate some of the inactive cylinder drag forces reducing the power output of the active cylinders the present invention maintains the throttle valve of the inactive cylinders closed, blocking all flow of fuel and air to those inactive cylinders. As a result, the inactive cylinders operate in essentially a vacuum environment which aids in the movement of the inactive cylinders, reducing the drag on the active cylinders as the crankshaft turns. It is believed that this greater vacuum environment aids the movement of the inactive piston from the bottom dead center position to the top dead center position during its stroke.

In an alternate embodiment, the throttle valve controlling the inactive cylinders is maintained in a slightly open position to provide just enough fuel and air mixture to cause the inactive pistons to produce enough power to move themselves within the inactive cylinders. This throttle valve will still open further when necessary to cause the inactive cylinders to operate as active cylinders under higher load requirements.

BRIEF DESCRIPTION OF THE DRAWINGS

FIG. 3 is a detailed plain view of the primary and secondary throttle system showing the first primary throttle valve opening by the accelerator linkage;

FIG. 4 is a detailed plain view of the primary and secondary throttle system showing the first secondary throttle opening by the progressive linkage and the first diaphragm control;

FIG. 5 is a detailed plain view of the primary and secondary throttle system showing the second primary and second secondary throttle valves opening by the second diaphragm control; and FIG. 6 is a sectional view taken along the lines of 6—6 in FIG. 2.

DETAILED DESCRIPTION OF THE INVENTION

Figure 1:
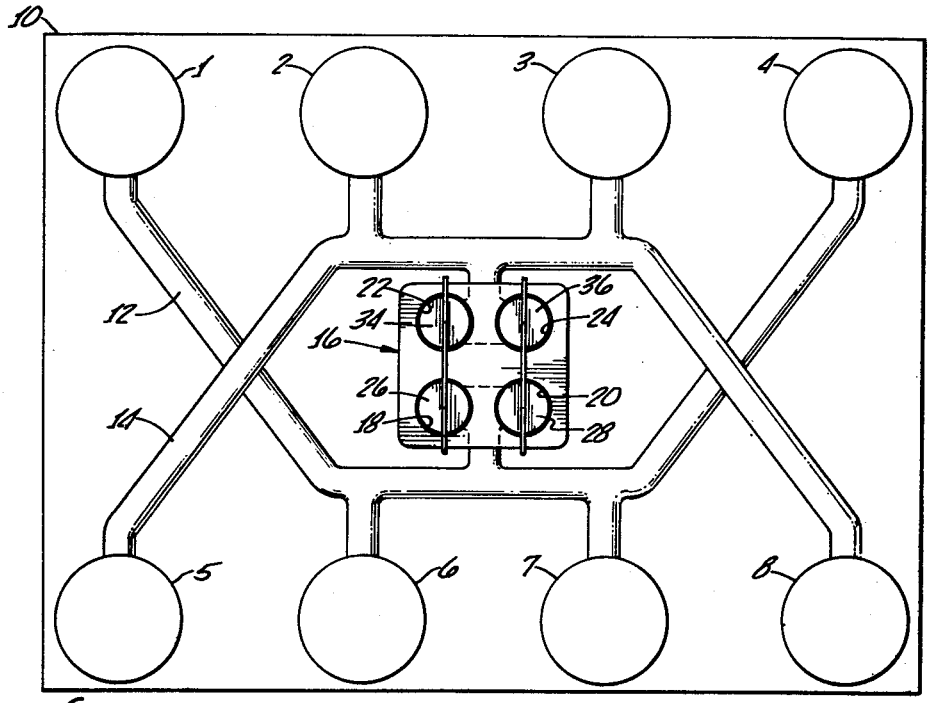
FIG. 1 is a schematic plain view showing the primary and secondary throttle system connected to the inlet manifolds of each group of cylinders in the split engine.

FIG. 1 shows schematically the general arrangement of the cylinders in a typical eight cylinder automobile engine. The cylinders 1, 2, 3, and 4 are aligned on one side of the engine 10 and the cylinders 5, 6, 7 and 8 are aligned on the other side. The primary cylinders 1, 6, 7 and 4 are connected to the primary intake manifold 12 while the secondary cylinders 5, 2, 3 and 8 are connected to the secondary intake manifold 14. Each of the cylinders contain respective pistons (not shown) which reciprocate with the cylinders to produce power in the engine. Connected to both the primary and secondary intake manifolds 12 and 14 is a throttle system 16 to control the flow of the fuel and air mixture into said respective primary and secondary intake manifolds.

Located in the throttle system 16 are a first and second primary throttle apertures 18 and 20 as well as a first and second secondary throttle apertures 22 and 24. It is through the primary throttle valve apertures 18 and 20 that the fuel and air mixture will flow that enters the primary cylinders 1, 6, 7 and 4. Similarly, the fuel and air entering the secondary cylinders will flow through the secondary throttle apertures 22 and 24.

Figure 2:
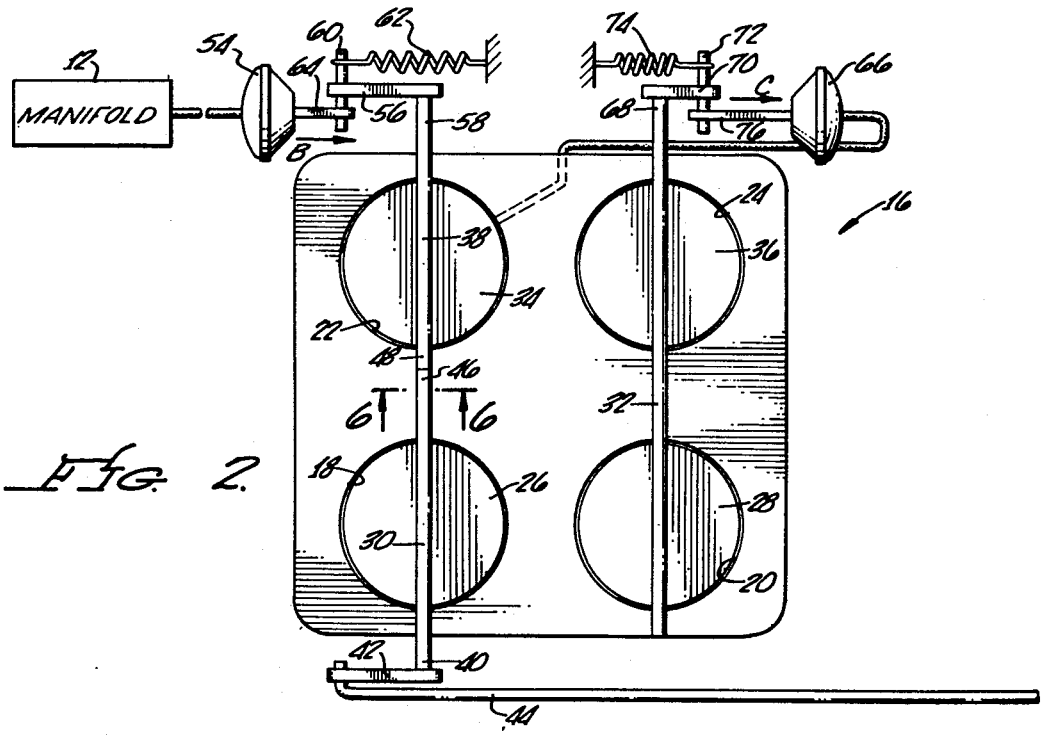
FIG. 2 is a detailed plain view of the primary and secondary throttle system in the closed or non-operating position showing the progressive linkage interconnection between the throttle as well as the diaphragm controls.

As shown more clearly in FIG. 2, in order to control the flow of fuel and air through the primary throttle apertures 18 and 20 the primary throttle valves 26 and 28 are placed within the apertures 18 and 20. The primary throttle valves 26 and 28 are respectively mounted to pivot on a prime throttle shaft 30 and a second throttle shaft 32 within the respective apertures 18 and 20.

Likewise, to control the flow of fuel and air through the secondary throttle apertures 22 and 24 a pair of secondary throttle valves 34 and 36 are respectively mounted within the secondary throttle apertures 22 and 24. The secondary throttle valves 34 and 36 are respectively pivoted on a responding throttle shaft 38 and the second throttle shaft 32.

Connected to the outside end 40 of the prime throttle shaft 30 is a linkage member 42 which is rotated about the axis of the prime throttle shaft 30 by an accelerator control linkage 44. The inside end 46 of the prime throttle shaft 30 interconnects with the inside end 48 of the responding throttle shaft 38. FIG. 6 shows this interconnection in more detail. The inside end 46 of the prime throttle shaft 30 has a half cylindrical shaped portion while the inside end 48 of the responding throttle shaft 38 has an approximate quarter cylindrical shaped portion. As the prime throttle shaft 30 turns in the direction of the arrow A by the accelerator control shaft 44 of FIG. 2, the first primary throttle valve 26 is opened from the closed position over the primary throttle aperture 18. When the contact surface 50 of the prime throttle shaft 30 in FIG. 6 proceeds around and meets the responding surface 52, the responding throttle shaft 38 will be moved in the direction of the arrow A, opening the first secondary throttle valve 34 from its generally closed position over the secondary throttle aperture 22 in FIG. 2 in order to allow the secondary cylinders to contribute to the power output of the engine.

It should be noted that in FIG. 6 the cross sectional shapes of the inside end portions 46 and 48 of the respective prime throttle shaft 30 and the responding throttle shaft 38 can be varied to depend on how far it is desired to open in FIG. 2 the first primary throttle valve 26 before opening the first secondary throttle valve 34. This design of a progressive linkage between the prime throttle shaft 30 and the responding throttle shaft 38 can be varied to meet the needs of the particular engine.

In conjunction with or separate from the use of a progressive linkage arrangement a vacuum diaphragm mechanism 54 in FIG. 2 can be utilized to control the opening of the first secondary throttle 34. An action lever linkage 56 is connected to the outside end 58 of the responding throttle shaft 38. The action lever linkage 56 is attached by a connecting pin 60 to a spring 62 which is arranged to bias the action lever linkage to rotate toward a direction to rotate and open the first secondary throttle valve 34. A diaphragm stem 64 is also attached to the action lever linkage 56 by the connecting pin 60. The vacuum diaphragm mechanism 54 operates in response to the primary intake manifold 12 shown in FIG. 1. As the vacuum decreases within the primary intake manifold with increased need for engine power, the diaphragm stem 64 will be released by the diaphragm 54 to move in the direction of the arrow B, allowing the spring 62 to rotate the action lever linkage 56 and open the first secondary throttle valve 34.

Because the first primary throttle valve 26 is opened to give the engine power and cause the corresponding decrease in vacuum in the primary intake manifold 12, the rotation of the prime throttle shaft 30 will allow an opening rotation of the responding throttle shaft 38 by the diaphragm 54 release and the spring 62 force even though in FIG. 6 the contacting surface 50 has not been rotated far enough to meet the surface 52. Thus, the vacuum diaphragm acts as an aid in opening the secondary throttle valve 34 in addition to the progressive linkage between the respective inside ends 46 and 48 of the prime throttle shaft 30 and the responding throttle shaft 38. The vacuum diaphragm mechanism, however, could be used as the sole control for opening the first secondary throttle valve 34 if desired. In such a case the prime throttle shaft 30 and the responding throttle shaft 38 would not connect.

In order to control the opening of the second primary and second secondary throttle valves 28 and 36 in FIG. 2 a second vacuum diaphragm 66 is used. One end 68 of the second throttle shaft 32 is connected to a throttle linkage 70 which rotates about the axis of the second throttle shaft 32, opening or closing the throttle valves 28 and 36. Connected to the throttle linkage 70 by an attachment pin 72 is a spring 74 which biases the throttle valves 28 and 36 in the closed position. Also connected to the throttle linkage 70 by the attachment pin 72 is a diaphragm stem 76 which moves in the direction of the arrow C. The second diaphragm 66 is connected to the venturi portion of the first secondary throttle aperture 22 and moves the stem 76 in response to the vacuum change. As the vacuum increases in throttle aperture 22 indicating higher power requirements, the second diaphragm 66 moves the stem 76 against the closing bias of the spring 74 to rotate open the throttle valves 28 and 36, giving more fuel and air to both the primary and secondary cylinders to provide additional power output from the engine.

Turning to the overall operation of the present invention, it is envisioned that most multicylinder internal combustion engines, particularly automobile six and eight cylinder engines, will operate under most normal conditions more efficiently with only half of the cylinders actively producing power. The remaining half, being inactive, have the capability to become active when the engine load requires it. Referring to FIGS. 1 through 3, as the engine is being operated under the normal relatively light load requirements or stage one mode of operation, fuel and air are allowed into the primary intake manifold 12 for operation of the primary cylinders 1, 6, 7 and 4. The flow of fuel and air is controlled by the first primary throttle valve 26 which is operated by the accelerator control linkage 44. As the accelerator control linkage 44 is moved in the direction of arrow D in FIG. 3, the primary throttle shaft 30 and first primary throttle valve 26 are rotated in the direction of arrow A.

During this time the first secondary throttle valve is maintained in a generally closed position not contributing to the power output of the engine. Also the throttle valves 28 and 36 are kept closed. When no air and fuel is allowed into the secondary intake manifold 14, the respective pistons (not shown) in the inactive or secondary cylinders 5, 2, 3 and 8 operate in a partial vacuum environment as they are turned by the engine crankshaft (not shown). The inlet and exhaust valves of each of the secondary cylinders will operate normally, but, since the first and second secondary throttle valves 34 and 36 are closed, the normally reciprocating secondary cylinders will pump essentially all of the air out of the secondary inlet manifold 14. Therefore, the secondary cylinders will be operating in a partial vacuum, since no air is drawn into the secondary cylinders. Consequently, the downward stroke of each of the inactive pistons creates a vacuum in each of the respective inactive cylinders which aids in the upward stroke of each of the inactive pistons. Empirically, this vacuum environment of the inactive cylinders has been found to result in the least amount of drag forces caused by the inactive cylinders on the power produced by the active cylinders.

Referring to FIGS. 4 and 6, as the prime throttle shaft 30 is rotated open so that surface 50 on throttle shaft 30 engages surface 52 on the throttle shaft 38, a further opening of the primary throttle valve 26, indicating greater power requirements or stage two mode of operation, will open the secondary throttle valve 34. This will permit fuel and air to enter the secondary cylinders 5, 2, 3 and 8 in FIG. 1, so that additional power is produced. Furthermore, even before surface 50 of the throttle shaft 30 contacts surface 52 of throttle shaft 38, the vacuum within the primary intake manifold may have dropped sufficiently to cause the diaphragm 54 to move the stem 64 to allow the opening of the throttle valve 34.

With respect to FIG. 5, if additional power is needed, indicated by a sufficient vacuum increase in the first secondary throttle aperture 22, the second diaphragm 66 will move the stem 76 to open the throttle valves 28 and 36 to respectively allow more fuel and air into the primary and secondary cylinders.

When the first primary throttle valve 26 is moved to the closed position, the closing contact surface 80 in FIG. 6 of the prime throttle shaft 30 moves the closing surface 82 of the responding throttle shaft 38 to also close the first secondary throttle valve 34. Also if the vacuum in the primary intake manifold 12 increases sufficiently, the diaphragm 54 will move the stem 64 to close the throttle valve 34. As the vacuum in the venturi portion of the secondary throttle aperture decreases sufficiently, the second diaphragm 66 will move the stem 76 to allow the spring 74 to close the throttle valves 28 and 36.

In an alternate embodiment of the present invention, the first secondary throttle valve 34 is always in a generally closed position, but allows a slight amount of fuel and air in the secondary cylinders adequate to generate enough power to turn themselves and, therefore, eliminate power output losses to the primary cylinders. In this generally closed position the secondary cylinders do not contribute to the power output of the engine.

A further embodiment of this invention uses the same interconnection between the prime throttle shaft 30 and the responding throttle shaft 38 shown in FIGS. 2 and 6. Also, the action lever linkage 56 is attached to the outside end 58 of the responding throttle shaft 38. The spring 62 is connected to the action lever linkage 56 in the same manner as in FIG. 2 but no diaphragm 54 is used. The spring 62 biases the first secondary throttle valve 34 toward the open position; however, if the first primary throttle valve 26 is closed, the closing surface 80 on the prime throttle shaft 30 will prevent rotation of the responding throttle shaft 38 and opening of the first secondary throttle valve 34. As the accelerator control shaft 44 opens the first primary throttle valve 26, the spring 62 will open the first secondary throttle valve 34, because, although the movement of the secondary cylinders at the idling speed of the primary cylinders operate in a slight partial vacuum which would tend to hold the throttle valve 34 closed, the spring 62 is strong enough to overcome this slight vacuum. The more the first primary throttle valve 26 is opened, the further the first secondary throttle valve 34 can be opened by the spring 62. This is a result of the combination of the spring 62 and the fact that, as the throttle valve 34 is opened more, the vacuum within the secondary cylinders will decrease more, resulting in less tendency to hold the throttle valve 34 toward the closed position.

When the engine has reached cruising speed, requiring no more acceleration, the release of the accelerator control linkage will close the first primary throttle valve which will in turn close the responding throttle shaft 38 cutting off all fuel and air to the secondary cylinders because of the control of the closing contact surface 80 of the prime throttle shaft 30 with the closing surface 82 of the responding throttle shaft 38. If the accelerator control linkage 44 gradually opens the first primary throttle valve while the engine is at cruising speed, the greater vacuum within the secondary cylinders because of the engine's higher speed will tend to hold the first secondary throttle valve 34 closed in spite of the spring 62. The vacuum in the secondary cylinders can adjust for this gradual change and prevent the spring 62 from opening the secondary throttle valve 34. Therefore, a gradual increase in fuel and air supply to the primary cylinders at cruising speeds of the engine will still allow the engine to operate on only the primary cylinders. However, if the accelerator control linkage quickly opens the first primary throttle valve 26 in response to an immediate demand for greater power requirements from the engine, the abrupt change does not allow the vacuum in the secondary cylinders to adjust sufficiently to hold the spring 62, and the first secondary throttle valve will be opened by the spring 62. The engine then is receiving power from both the primary and secondary cylinders.

When the demand for the higher power requirements ceases, the first primary and secondary throttle valves 26 and 34 are closed, allowing the engine to again cruise on only the primary cylinders.

Although the above discussion was directed primarily to an eight cylinder engine with a four barrel carburetor, it is envisioned that the principles of the invention can be equally applied to any multicylinder engine with various carburetors to gain optimum engine efficiency and fuel economy.

What is claimed is:

1. A split engine comprising:

a pair of carburetor barrels, each connected to independently controlled cylinders of said engine;

a first throttle valve for selectively closing one of said pair of barrels;

a second throttle valve for selectively closing the other of said pair of barrels;

first means for selectively opening said first throttle valve; and second means responseive to said first means for selectively opening said second throttle valve when said first throttle valve is opened a predetermined distance.

2. A split engine carburetor comprising:

a first throttle valve controlling a first cylinder;

a second throttle valve controlling a second cylinder;

means for actuating said first throttle valve between two extreme positions; and means for actuating said second throttle valve when said first throttle valve reaches a predetermined position between said two extreme positions.

3. A split engine carburetor as defined in claim 2, wherein said means for actuating said first throttle valve comprises a primary throttle shaft for rotating said first throttle valve and wherein said means for actuating the second throttle valve comprises a secondary throttle shaft cooperatively coupled to said primary throttle shaft.

4. A split engine carburetor as defined in claim 3, wherein said primary throttle shaft includes a segmented cylindrical portion and wherein said secondary throttle shaft includes a segmented cylindrical portion cooperating with the segmented cylindrical portion of said primary throttle shaft, said segmented cylindrical portions abutting when said first throttle valve reaches said predetermined position.

5. A split engine carburetor as defined in claim 4, wherein said segmented cylindrical portion of said primary throttle shaft comprises a semi-cylindrical portion and wherein said segmented cylindrical portion of said secondary throttle shaft comprises a cylindrical segment greater than 90° and less than 180°.

6. A split engine carburetor as defined in claim 2 additionally comprising:

means for overriding said means for actuating said second throttle valve, said means operating said second throttle valve in response to vacuum in the intake manifold of said first cylinder.

7. A split engine carburetor as defined in claim 2 wherein said means for actuating said first throttle valve comprises an accelerator linkage and wherein said means for actuating said second throttle valve opens said second throttle valve when said first throttle valve has been opened to a predetermined position.

8. A split engine carburetor as defined in claim 2 additionally comprising:

spring means biasing said second throttle valve toward an unactuated position.

* * * * *